US005905936A

United States Patent [19]

Fenwick et al.

[11] Patent Number: 5,905,936

[45] Date of Patent: May 18, 1999

[54] METHOD AND APPARATUS FOR SHAPING SPHERES AND PROCESS FOR SINTERING

[75] Inventors: Lloyd Fenwick; Darryl Amick; Gary McDowell; Robert Nichols, all of Albany, Oreg.

[73] Assignee: Teledyne Wah Chang, Albany, Oreg.

[21] Appl. No.: 08/906,697

[22] Filed: Aug. 6, 1997

[51] Int. Cl.[6] ..... B22F 3/12; B22F 5/00

[52] U.S. Cl. ..... 419/2; 419/38; 419/58; 264/58

[58] Field of Search ..... 451/50, 104, 113, 451/74, 326; 419/2, 38, 58; 264/58

[56] References Cited

U.S. PATENT DOCUMENTS

| | | | |
|---|---|---|---|
| 3,103,770 | 9/1963 | Carter et al. . | |
| 3,104,502 | 9/1963 | Burch, Jr. . | |
| 3,791,083 | 2/1974 | Messerschmidt . | |
| 3,847,000 | 11/1974 | Teague . | |
| 3,987,590 | 10/1976 | Chianelli . | |
| 4,903,439 | 2/1990 | Hoffmann . | |
| 5,411,267 | 5/1995 | Burks et al. . | |
| 5,520,573 | 5/1996 | Sumita et al. . | |
| 5,665,440 | 9/1997 | Menchhufer | 428/34.5 |
| 5,744,231 | 4/1998 | Igarashi et al. | 428/318.6 |

*Primary Examiner*—Daniel J. Jenkins
*Attorney, Agent, or Firm*—Shoemaker and Mattare Ltd.

[57] ABSTRACT

Generally rough sphere-shaped work pieces made of fragile material are ground into more uniform spheres. The rough spheres are fed into a holding plate having a channel cut into the bottom side of the plate with a width slightly larger than the largest diameter of the rough spheres. A movable abrasive surface is positioned adjacent to the bottom side of the holding plate. As the rough spheres move through the holding plate which can be vibrated, they move in contact with each other and with the abrasive surface. The finally formed spheres leave the plate where they are collected. It is a further embodiment green spheres which are treated in a sintering process with hydrogen gas have tungsten oxide particles applied to the surface of the spheres prior to and during sintering so that the particles remain separated and apart.

4 Claims, 2 Drawing Sheets

METHOD AND APPARATUS FOR SHAPING SPHERES AND PROCESS FOR SINTERING

BACKGROUND OF THE INVENTION

1. Field of the Invention

This invention relates to a process for abrading, shaping and grinding fragile materials prior to sintering or firing in the case of ceramic materials and for sintering spheres by using particles of tungsten oxide as a separating agent.

2. Description of the Previously Published Art

Conventional grinding techniques for producing spheres such as metallic balls of steel, bronze, brass aluminum and the like for use as ball-bearings and similar fabrication, involve operations employing dense, hard materials. Those methods are generally unfit for similar use involving fragile substances such as green ceramics and pressed powder compacts prior to sintering or firing. For those harder substances, the grinding process usually uses two grinding surfaces such as discs and belts, both applied with pressure against the object to be polished or ground. Such a process is used, for example, in U.S. Pat. No. 3,791,083 to Messerschmidt. However, green ceramics and powder compact substances such as ceramics and various alloys such as iron are brittle by comparison and they are easily fractured or crumbled when pressure is applied during a grinding or finishing or shaping operation.

Green ceramics and powder metallurgical compacts in large numbers can most conveniently be formed into a generally spherical shape by compaction in a multiple cavity die shaped to produce spherical shape. Unfortunately, this produces spherical shapes with parting lines or belts which must be removed either prior to firing or sintering or subsequently. After firing or sintering, the removal process is considerably more difficult where the materials are relatively hard compared to the grinding medium. This makes the grinding operation slow and expensive.

It is known to hold the work pieces in a substantially static position in small numbers for polishing and abrading with pressure. U.S. Pat. No. 3,103,770 to Carter discloses a technique for shaping a single crystalline sphere at a time or at best a limited number. This is done by a vertical tube into which is dropped a single work piece at a time and requires pressure to be placed downwardly by a weight to hold the work piece against the grinding surface. It is acknowledged that the machine output is limited, but can be increased somewhat only by increasing the number of holding devices. However, it is still providing each vertical tube with only a single sphere at a time which is extremely limited. Except for limited movement of the sphere against the grinding surface, the sphere is basically stationary in the vertical tube.

U.S. Pat. No. 4,903,439 to Hoffman discloses a vertically-oriented tube which also provides for polishing and grinding into a sphere a single rough-shaped object at a time which is held in substantially the same place.

There clearly is a need for a process and apparatus which avoids the use of a pressure device downwardly forcing the work piece against a grinding surface and which provides for a large number of work pieces to be rapidly, safely and efficiently ground and processed at one time in a uniform manner.

There is also a need for an expensive separating agent to keep spheres apart when they are being sintered in a hydrogen containing atmosphere.

3. Objects of the Invention

It is an object of this invention to provide an improved technique for simultaneously grinding and abrading a large number of roughly formed work pieces to form true spherical shaped objects.

It is another object to provide techniques for forming true spherical-shaped objects in large quantities of green ceramic articles and pressed powder metallurgical compacts.

It is another object of this invention to provide a production process for rapidly and economically shaping large numbers of spheres of green ceramics and powdered metals such as iron alloys like Fe and W of varying weight/weight percentages.

It is another object of this invention to provide a new process of utilizing the surfaces of the spheres themselves by their dynamic motion to grind a smooth spherical surface.

It is another object of this invention to provide a process by which a large number of work pieces are simultaneously rapidly, safely and efficiently ground into spherical shapes in a substantially uniform manner.

It is a further object of the invention to provide a sphere grinding apparatus where the work pieces progressively move through a channel in a plate while being abraded and moved along the channel by a movable abrasive surface, to thereby continuously form the final smooth spheres.

It is a further object of the invention to provide a sphere grinding apparatus where as the work pieces are moved through a channel in a plate to be abraded by a movable abrasive surface, as well as vibration of the channel. The work pieces are not under pressure as they contact the abrasive surface.

It is yet a further object of the present invention to provide a process whereby pressed powdered metal compacts are rendered spherical and subsequently sintered in an atmosphere containing hydrogen, in the presence of powdered or particulate metal oxide or metal oxides or mixtures of metal oxides to produce sintered metal spheres and particulate metal suitable for further use in making the powdered metal compacts or other forms of the metal made from the reduced metal oxides.

It is a further object of the invention to reduce fusion of the separate spheres to adjacent spheres during sintering at high temperatures in a hydrogen atmosphere by applying tungsten oxide particles to the surface of the spheres prior to sintering.

These and further objects of the invention will become apparent as the description of the invention proceeds.

SUMMARY OF THE INVENTION

A method and apparatus have been developed whereby generally sphere-shaped work pieces made of green ceramic or pressed powdered metals can have their non-uniform surfaces ground into more uniform spheres. The method makes use of at least one holding plate having a channel cut into the bottom side of the plate with a width slightly larger than the largest diameter of the work pieces. The channel has an entry port at one end and an exit port at the other. A movable abrasive surface is positioned adjacent to and spaced from the bottom side of the holding plate. Generally, sphere-shaped work pieces to be shaped are supplied to the top side of the holding plate and through the plate into the entry port of the channel. Preferably, the holding plate is vibrated to cause the work pieces in the plate channel to move in contact with each other and with the abrasive surface. As the finally formed sphere shaped work pieces leave the exit port of the plate, they are collected.

It is a further aspect of this invention to separate pressed powder compacts of metallurgical metals when sintering them in a hydrogen gas containing atmosphere by applying metal oxide particles to the surface of the spheres prior to sintering under conditions of time and temperature to insure that the spheres remain separated and apart.

DESCRIPTION OF THE PREFERRED EMBODIMENTS

The present invention utilizes a substantially flat plate, having routed channels which are open from one face of the plate and are formed in a serpentine or zig-zag fashion to provide access to the work pieces by the grinding surface located adjacent to one face of the plate of the work pieces, and thereafter, the final spheres leave via an exit port after the pieces have traversed that tunneled route.

In its operation, the abrasive surface, such as a rotating wheel or belt, engages the work pieces causing them to move along the channel and to rotate randomly and to change their axes. In addition, the spheres move up and down, striking the top and sides of the holding plate and also striking each other. This movement occurs within the grooves in a linear and progressive fashion so that the spheres are constantly traveling along the serpentine path from entry to exit. The repeated contact of the spheres is accompanied by the presence of grinding dust and grit which makes each traveling work piece its own grinding device to spheres adjacent to it. In this manner, the random changes of the axes are coupled with an unrestrained, horizontal path of travel from entry to exit.

During its passage in the grooves, each work piece is held without the need of a pressure-imparting tool or device so that it moves freely for the entire length of the channel in a dynamic fashion. As it moves, it hits both sides of the channel, the upper surface of the channel, the lower surface of the abrasive material, as well as striking the adjacent work pieces. Each channel or groove is larger in cross-section than that of the spheres so that, there is ample room for the spheres to move in a path from the entry port through to the exit port for collection. This continuous dynamic movement and the directional flow of the spheres is a novel embodiment which has not been shown in the art.

As will be seen, this is in sharp contrast to the Carter U.S. Pat. No. 3,103,770, where each solitary work piece is restrained and motionless within a vertical tube with little relative motion or contact with any other sphere. The bombardment of the pieces by grinding dust, grit and particulate matter sets the pieces into rebounding motion. This motion can be affected by the variables of work piece hardness and fragility, grit size, speed and velocity of the grinding surface disc or belt.

In one aspect of this invention, there are provided means for holding work pieces in a random fashion and presenting them to be ground and polished in a substantially round shape which will be of a lesser diameter than that when first started, by use of a pressureless process.

The holding plate used herein provides a series of serpentine grooves or channels which can be used singly or in multiple series. These plates are so positioned and constructed as to provide for the rapid working through of the roughly shaped work pieces into spheres in a dynamic and continuous manner and with continuous feeding.

Figure 1:
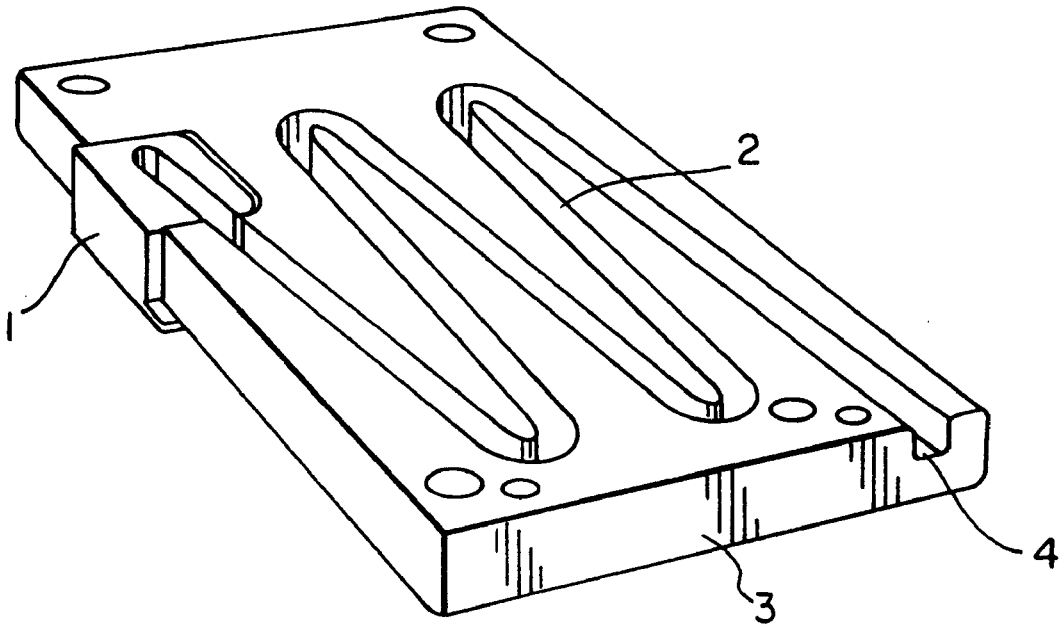
FIG. 1 is a plan view of the bottom of the maze plate showing zig-zag channels.
Figure 2:
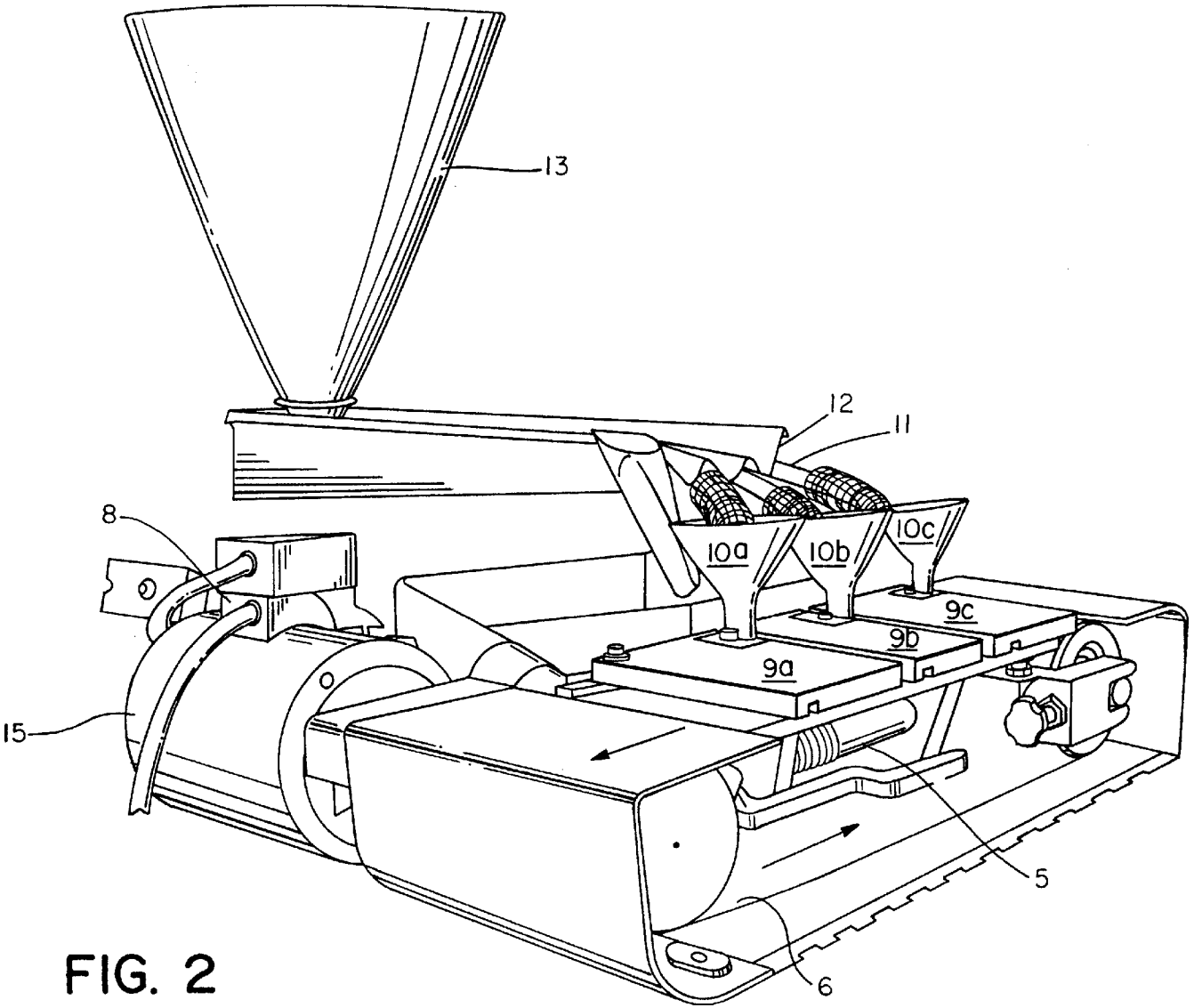
FIG. 2 is a plan view of the apparatus used in this process.

FIG. 1 shows the bottom side of the polycarbonate plate 3 which has been milled and machine lathed to produce a series of channels 2, preferably, only wide enough to loosely accept crude belted spheres within the elongated zig-zag pattern, about ⅛" wide in the preferred embodiment. Each channel of the plate is provided with an outlet gate or exit port 4 positioned to permit the spheres to pass from the entry port 1 downstream from where they are fed, to the exit port for collection. Under the preferred embodiment, this maze-plate is turned upside down and positioned substantially horizontally and suspended without pressure, about 1/16" above the surface of the grinding surface of a conventional belt sander, as shown in FIG. 2. This is just sufficient to permit effective contact of the sphere surface with the grinder and allow vibration to give dynamic motion to the spheres. The direction and translational speed of the spheres is regulated by means for changing the angle of the plate 3 with respect to the direction of the belt on the belt sander.

The multiple work pieces to be ground into spheres are fed into the feed chute 12 from a feed hopper 13 and then onto the abrasive belt 6 through an opening 1 in the top side of the maze plate. After grinding and finishing, the spheres are discharged for collection by a chute (which is not shown). Appropriate rotational speeds of both the rake, the vibrating device 8, operating with a 20 horse-power motor 15, and the grinder are empirically determined. The vibrated feed chute is split into a 3-way section 11 to direct the work pieces into each maze corresponding thereto 9*a*, 9*b*, 9*c*. Overflows of pieces, if any, are collected in the back of these cones 10*a*, 10*b*, 10*c*. Once processed, the finished spheres are collected at the final collection chute (not shown), fitted to the bottom front of the plates 3 so that any spheres discharged from the exit 4 are received and directed into an appropriate collection container. Excess grinder dust can be collected to be used again if needed.

Having described the basic aspects of the invention, the following example is given to illustrate a specific embodiment thereof.

EXAMPLE 1

About 215 crudely-shaped work pieces with equatorial-shaped bands resulting from their manufacture by compacting metal powders of 50% Fe and 50% W, in a known compacting process to those skilled in the art, are used as follows. Having a diameter of about 0.190 inch they are poured into a steel receiving chute of a feed hopper such as 13 in FIG. 2 having dimensions of about 3×8×12. The hopper and chute are vibrated by a vibrating machine to facilitate the flow of the belted spheres into a multi-splitter (3-way) and then into an enclosed trough so that overflow is avoided. Feeder cones, corresponding in number to each of the troughs and holding plates, direct the spheres to be worked to inlet ports (1) of a polycarbonate machined plate having serpentine or zig-zag channels or grooves made to accommodate the work pieces and permit free flow of the closely contacted work pieces. These channels are bored to have an inside lateral dimension just slightly larger than the largest diameter of the pieces and spheres and only deep enough to permit movement in all directions including up and down to contact the grinding surface and only sideways against each other. The bore is wide enough to permit the directional flow of the work piece toward the exit ports from which they are collected as finished spheres. Once set in motion and exiting, the spheres provide space for yet additional spheres to be accepted in the entry port and follow in the channel. The throughput speed of the finished spheres will be a function of the speed of the belt, its capacity to remove high spots on the spheres which will depend on the kind and coarseness of the grit employed and the angular adjustment of the plates with respect to the direction of movement of the belt. With the kind of apparatus described, these variables can be adjusted easily to determine the optimum conditions for both green ceramic articles and powder metal compacts. Binder selection for both kinds of starting materials can be any conventional binders which will be easily removed by subsequent firing, in the case of ceramic green bodies, and sintering in the case of powdered metal compacts.

The plates used are machined about 2" thick and are horizontally positioned at a height of about 1/16" above the grinding surface. This is sufficient to permit the grinding surface to contact the work piece surface. Having an abrasive of about 60 grit, as the process continues, the grinder dust is trapped inside the surface and surrounding areas of the plate and its channels and it surrounds the spheres. This causes the spheres to move dynamically against each other and enhance the grinding process. As the finished pieces exit the maze plates, they leave room for the other work pieces in the feed hopper, traveling in a fluidize bed fashion enhanced by gravity flow. The vibrations of the vibrator and the incoming flow of the work pieces forces the flow outwardly. After grinding, the spheres are found to have a substantially uniform diameter of 0.180" plus or minus 0.002". No breakage appeared in the process and the finished lot started and finished in about 26 minutes. The direction and translational speed of the finished pieces and the resulting spheres is regulated directionally as previously described. Other regulating mechanisms could be used if desired to hold the spheres in the channels a longer period of time before discharge. For example, tines or blocking tabs (not shown) which are periodically removable from blocking the discharge of the spheres from the channels, can be employed if desired or required due to grit selection or the speed of the belt.

A further aspect of the invention relates to an improvement in keeping spheres separated when they are sintered in a hydrogen containing atmosphere.

When making spheres out of fragile material such as a 50—50 weight percent mixture of iron powder and tungsten powder, a six-step process is used as follows.

1. Press the powder with a binder to form a sphere which will have a band or "orbit" around it where the two hemispheric dies come together.

2. Grind the green spheres, as described herein, to remove the band or "orbit" around the midsection and make them more spherical.

3. Place the "green" sphere in an oven to burn off the binder and form a dense product.

4. Sinter the spheres at a high temperature and in hydrogen containing atmosphere to form a spherical product of the desired hardness, tensile strength and density.

5. Contact the sintered spheres with a large grinding wheel to break up twins which are two spheres stuck together, and achieve finished size.

6. Classify the spheres so that they are separated into the proper preselected commercial sizes.

During the sintering in step 5, the heated spheres may become tacky and tend to stick together. There is often a need to space the particles apart. Various particulate additives have been used. However, these additives can be expensive and they may remain as a part of the sphere as an unwanted contamination.

It has been discovered that by using relatively inexpensive $WO_2$ powder on the outer surface of the spheres during sintering, the powder keeps the spheres apart. The $WO_2$ powder is not prone to stick to the surface of the spheres at the temperatures and conditions employed in the sintering process. Further, advantageously the conditions for sintering, including a hydrogen containing atmosphere, will reduce the $WO_2$ to tungsten metal which can be used in the powder metallurgical compacts with Fe or any other mixture where the properties of the tungsten including its specific gravity, are desired. For example, in the production of various sizes of metal spheres containing Fe and W, in various proportions suitable for use as a substitute for lead or steel shot in the shotgun shotshells. To the extent that some of the tungsten metal so produced remains on the sphere surface, this is not considered contamination because it adds just a slightly bit more of one of the two components which is already in the sphere.

To the extent that the tungsten powder forms on the sphere and falls off the end of the sintering process, this tungsten can be recovered and used at the front end of the process as one of the raw material ingredients for making the iron-tungsten spheres. To the extent that some of the tungsten in the sphere is converted to tungsten oxide during the initial heating in Step 3, this tungsten oxide powder can be recovered and used as the separating particulate in step 4.

The conditions for sintering described herein, e.g. approximately 1500–1520° C. is higher than those normally used for the reduction of tungsten oxide to the metal. The latter can be accomplished at a temperature of about 1000° C. At the higher temperatures, the reaction is driven to the right:

$$WO_3+3H_2 \leftrightarrows W+3H_2O$$

by the presence of some minimum ratio of hydrogen to water partial pressure which ($H_2$:$H_2O$) is lower than encountered at 1000° C. This permits the formation of W with an acceptably low oxygen content by simple adjustment of the hydrogen partial pressure. Flow rates can be adjusted to obtain the optimum conditions without undue experimentation. It is even contemplated that green ceramic bodies of tungsten oxides and iron or iron alloys can be employed to form in situ the desire Fe W spherical article.

After sintering, the final size can be achieved by grinding if desired. Preferably, a motor driven abrasive stone wheel (8"×24") is employed. The spherical shot to be ground is placed in a chute consisting of a steel box which is located at the top of the wheel and close enough to the wheel to prevent loss of the sphere charged. This clearance can vary with the size of the spherical shot being ground. During the operation of the grinder, a flexible polymer sheet located on the tail end of the chute or down stream as defined by the direction of rotation of the wheel, rests against the wheel and conforms to its shape during grinding and is flexible enough and rigid enough to perform the function of providing a baffel for keeping the spheres in the box or chute during grinding where the side of the steel box adjacent the plastic material is cut away adjacent the surface of the grinding stone to permit the finished spheres to escape from the chute but for the presence of the plastic baffel.

Once the chute is charged and the grinding wheel rotated at a preselected speed, the spheres percolate inside the chute in a fluidized bed fashion.

After the desired degree of grinding is completed, the plastic baffel can be retracted and the product allowed to exit the grinder by any suitable means and collected for sorting or classification into the desired preselected sizes.

The foregoing process descriptions can advantageously be employed with ceramic green bodies of any composition including $ZrO_2$ with or without stabilizers such as $Y_2O_3$, $CeO_2$, MgO and the like. Other ceramic formulations including alumina and the like can be employed without undue experimentation.

With respect to powder metallurgical compacts and sintered spherical product, the apparatus, system and method described herein is particularly well-suited for making shot-shell pellets in a spherical shape from a variety of materials including tungsten steel copper and the like, and mixtures thereof where specific gravities close to or greater than lead are desired for non-toxic lead substitutes. The process of the present invention, however, is not limited to any particular metals or combination of metals, or any particular materials capable of being employed in powder metallurgical applications where a spherical shape is desired may advantageously be used in the practice of the present invention.

It is understood that the foregoing detailed description is given merely by way of illustration and that many variations may be made therein without departing from the spirit of this invention.

What is claimed is:

1. A process for sintering spheres in a hydrogen atmosphere comprising applying tungsten oxide particles to the surface of the spheres prior to sintering to separate the spheres.

2. A process according to claim 1, wherein the spheres contain at least tungsten.

3. A process according to claim 1, wherein any tungsten oxide which is reduced to free tungsten metal during the sintering is recovered.

4. A process according to claim 1, wherein any tungsten oxide which is reduced to free tungsten metal during the sintering is recovered and reused in making the tungsten containing spheres.

* * * * *